US008978784B2

(12) United States Patent
Miszewski

(10) Patent No.: US 8,978,784 B2
(45) Date of Patent: Mar. 17, 2015

(54) DIRECTIONAL WELL DRILLING

(75) Inventor: Antoni Miszewski, Exeter (GB)

(73) Assignee: Antech Limited, Exeter (GB)

( * ) Notice: Subject to any disclaimer, the term of this patent is extended or adjusted under 35 U.S.C. 154(b) by 555 days.

(21) Appl. No.: 12/936,597

(22) PCT Filed: Apr. 1, 2009

(86) PCT No.: PCT/GB2009/050320
§ 371 (c)(1),
(2), (4) Date: Oct. 6, 2010

(87) PCT Pub. No.: WO2009/122211
PCT Pub. Date: Oct. 8, 2009

(65) Prior Publication Data

US 2011/0061938 A1 Mar. 17, 2011

(30) Foreign Application Priority Data

Apr. 1, 2008 (GB) ..... 0805855.4

(51) Int. Cl.
*E21B 7/06* (2006.01)

(52) U.S. Cl.
CPC ..... *E21B 7/067* (2013.01)
USPC ..... 175/73

(58) Field of Classification Search
CPC ..... E21B 7/067
USPC ..... 175/61, 74, 75, 101, 73
See application file for complete search history.

(56) References Cited

U.S. PATENT DOCUMENTS

| | | | | |
|---|---|---|---|---|
| 5,485,889 | A | 1/1996 | Gray | |
| 6,047,784 | A * | 4/2000 | Dorel | 175/61 |
| 6,059,050 | A * | 5/2000 | Gray | 175/73 |
| 6,176,327 | B1 * | 1/2001 | Hearn | 175/61 |
| 6,571,888 | B2 * | 6/2003 | Comeau et al. | 175/61 |
| 6,698,534 | B2 * | 3/2004 | Miszewski | 175/40 |
| 7,946,361 | B2 * | 5/2011 | Gurjar et al. | 175/61 |
| 7,987,927 | B2 * | 8/2011 | Downton | 175/61 |
| 2007/0151767 | A1 * | 7/2007 | Downton | 175/73 |

FOREIGN PATENT DOCUMENTS

| | | |
|---|---|---|
| EP | 0 787 886 A2 | 6/1997 |
| GB | 2 377 232 A | 8/2003 |
| WO | WO 01/46549 A1 | 6/2001 |

OTHER PUBLICATIONS

International Search Report, Apr. 2007.
Written Opinion, Jul. 2009.

* cited by examiner

*Primary Examiner* — Robert E Fuller
(74) *Attorney, Agent, or Firm* — Fay Sharpe LLP

(57) ABSTRACT

A drilling assembly comprises a bent housing terminating in a drill bit (18), and a top section coupled to the bent section. The top section is suspended upon coiled tubing (10). The drilling assembly includes an orienter means (2-6) capable of rotating the bent housing with respect to the top section, wherein the orienter means includes an electric motor (34) situated in the bent section. The bent housing includes sensor means (30) for monitoring downhole physical variables, the sensor means being situated in the bent section. The orienter means may be an electro-mechanical motor.

4 Claims, 1 Drawing Sheet

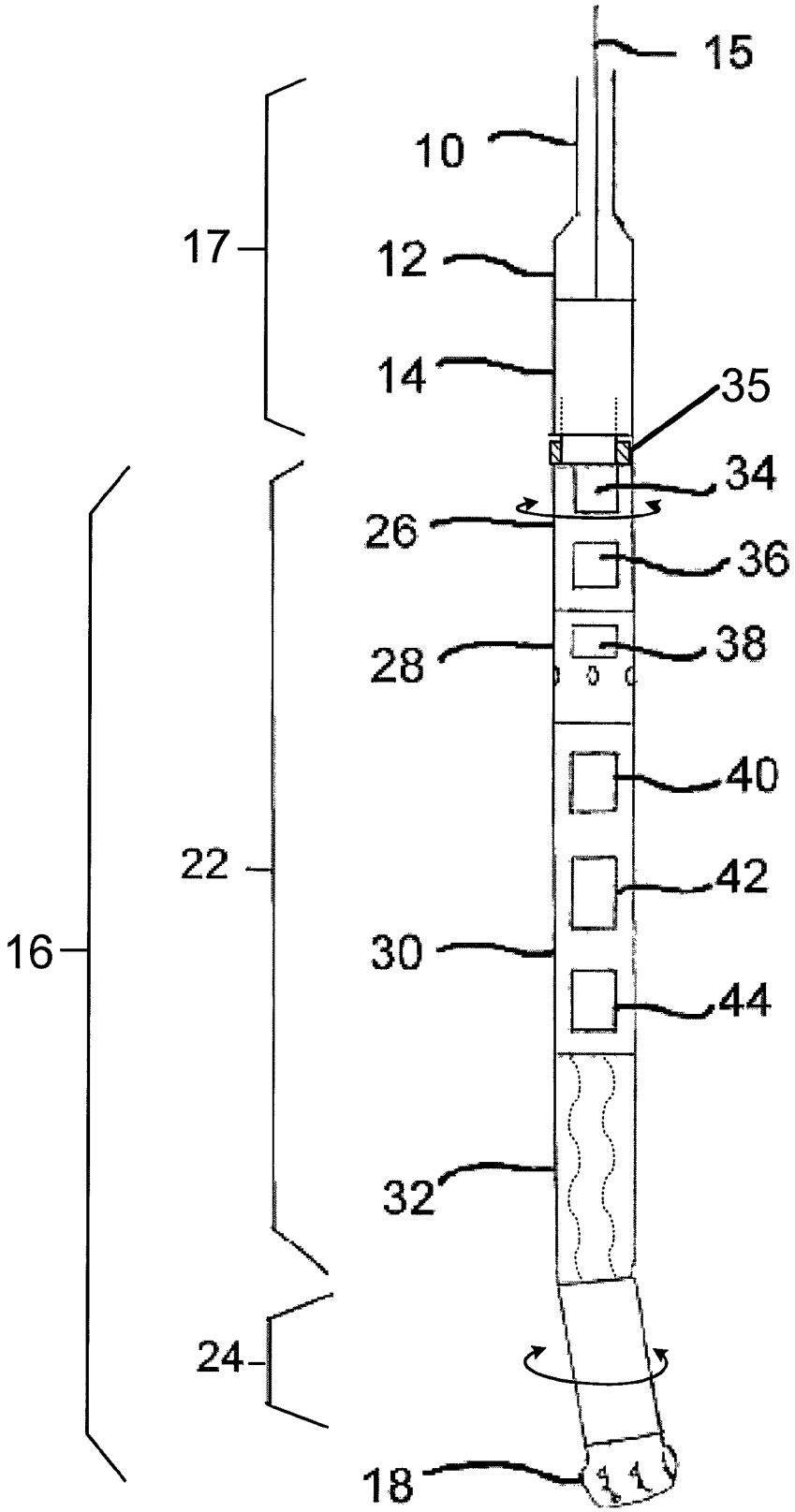
15
10
17
12
14
35
34
26
36
28
38
40
22
42
16
30
44
32
24
18

DIRECTIONAL WELL DRILLING

CROSS-REFERENCE TO RELATED APPLICATIONS

This application is a national stage entry of international application number PCT/GB2009/050320, having international filing date of Apr. 1, 2009, which was published in English, and which claims priority to Great Britain Patent Application No. GB 0805855.4, filed Apr. 1, 2008, the entireties of which are hereby incorporated by reference as if fully set forth herein.

This invention relates to directional drilling of bores, particularly (though not exclusively) to produce fluid such as oil or gas from an underground formation.

When drilling a borehole to extract oil or gas from an underground formation, it is often desirable to drill the borehole so that it includes one or more bends or curves. For example, it may be necessary to avoid an existing well, or to aim for the reservoir to be exploited. Similarly, in drilling a borehole to take piping and/or cables beneath a road or river, it is necessary to guide the course of the borehole.

EP0787886 (Anadrill) shows a drilling assembly including a bent housing having a bit mounted below a lower section, and a mud flow operated motor in said upper section for rotating said bit, the bent housing being suspended from a tubular housing. The tubular housing includes an orienter and sensors for rotating the bent housing, so that the bent housing can be oriented at a particular azimuth relative to tubular housing and the drill bit operated to drill a curved path in the direction of the azimuth, or the bent housing can be continuously rotated in order to drill a borehole that can be considered approximately straight (the path will actually describe a slight spiral).

According to the invention there is provided a drilling assembly comprising a bent housing or section terminating in a drill bit, and a top section coupled to the bent section, the top section being suspended upon coiled tubing, the drilling assembly including an orienter means capable of rotating the bent section with respect to the top section, wherein the orienter means includes an electric motor situated in the bent section.

According to another aspect of the invention there is provided a drilling assembly comprising a bent section terminating in a drill bit, and a top section coupled to the bent section, the top section being suspended upon coiled tubing, the drilling assembly including an orienter means capable of rotating the bent section with respect to the top section, and including sensor means for monitoring downhole physical variables wherein the sensor means are situated in the bent section.

One way of achieving straight hole drilling with a rotary orienter and a bent sub is to drill short curved sections and, before the bit deviates too far from the desired path, turn the bend through 180° to bring the borehole back on track. Repeating this procedure generates a hole that is effectively straight but on a smaller scale is tortuous. This tortuosity is amplified by the delay in taking directional measurements caused by the distance of the sensors to the bit (viz. Measurements at the Bit: A New Generation of MWD Tools, Oilfield Review April/July 1993). Tortuosity of the hole is bad because it increases the friction forces on the tubing and reduces the distance that can be drilled.

If the orienter will allow it, tortuosity can be reduced to almost nothing by continuously rotating the bent sub whilst drilling. In doing this the bit drills away from the desired path equally in all directions so a straight hole is drilled albeit with a very slight spiral.

The existing known bottom hole assemblies either cannot rotate continuously and/or the orienter is positioned below the sensors thereby setting them back from the drill bit. This can cause delays in the feedback of hole position.

In cases where they orienter is positioned close to the bit the orienter will experience a bending moment that is greater than that which would be experienced if it was placed further away. To drill, force is applied to the bit. The bent sub offsets the bit from the centreline to create the curve. The combined effect of this, depending on weight-on-bit and the angle of bend, is to create a bending moment along that tool that can be in the order of 1200 ft-lbf. The forces that resist this moment reduce in the direction away from the bend. Accordingly an orienter closer to the bend will experience greater bending moment on its weaker bearing section, and therefore mechanical stress, than one positioned away from the bend.

The reason cited for placing the orienter close to the bend is to reduce the torque required to rotate the motor and bend. However, in practice, this is only an issue for systems with low torque orienters.

FIG. 1 is a longitudinal view of an embodiment of the directional drilling assembly;

Referring to FIG. 1, the drilling assembly comprises a top section 17 with a cable head section 12 and a release section 14, and a bent section 16 and drill bit 18. The bent section 16 comprises an upper section 22 and a lower section 24. The upper section includes an orienter section 26, a valve section 28, a sensor section 30 and a mud motor 32, while the drill bit 18 is attached to the end of the lower section 24.

The drilling assembly is suspended on coiled tubing 10 by the cable head section 12. The coiled tubing includes an electric wireline 15, so that the coiled tubing and electric wireline can provide mechanical, electrical and hydraulic connections to the tool depending on requirements.

Beneath the cable head, the release section 14 is included which allows the coiled tubing and cable head section to be released from the rest of the drilling assembly. If the bottom hole assembly to become stuck in the borehole, the release section can be hydraulically or electrically activated so that the coiled tubing and cable head section can be removed from the well whilst the remainder of the drilling assembly can subsequently be fished using specialist tools adapted to freeing stuck tools.

The orienter section 26 is coupled to the electric release section. The orienter section includes an electric drive mechanism 34 which is ideally is an electro-mechanical type consisting on an electrical motor and a gearbox. Continuous rotation in either direction is possible. The orienter also includes a control means 36 which controls the drive means in response to instructions from an operator at the surface and the downhole sensors.

The orienter section 26 is attached to the valve section 28, which includes a valve control and drive means 38. In a drilling system, fluid flow performs two functions. It provides hydraulic power for the drill motor and it also washes away drill bit cuttings and transports them back to surface. Under many circumstances the same flowrate will adequately perform both functions. However, in some circumstances the flow through the motor needs to be less than that required to clean the borehole. In other circumstances it is bad to rotate the bit, for example in casing, when circulating fluids. The valve section controls the fluid flow to be circulated through ports above the motor.

Flow is exclusively down the middle creating a straight flow path. The orienter is positioned at the top of the BHA such that the swivel bearing section 35 is pointing upwards. The electronic control instrumentation of the orienter is located in the housing below the swivel bearing section 35 where it can be easily connected to the other measurement instrumentation in the BHA.

A sensor section 30 is attached beneath the valve section 28. The sensor section includes a multiple sensor block 40, which includes sensors measuring such variables as pressure, temperature, weight, torque and vibration. Downhole pressures are concerned with the performance of the drill motor and with ensuring that the pressures around the wellbore are at the correct level to prevent problems. Problems can occur with the structural integrity of the wellbore or by blocking the pores of the formation with too high pressures for the reservoir. Direct measurement of weight and torque give more accurate and responsive measurements than can be determined from surface measurements. The operator can then accurately control weight on the drill bit for best penetration whilst at the same time keeping an eye on the torque on the drill motor to prevent it stalling.

Also included in the sensor section 30 is a steering tool sensor 42, which is the directional sensor in the system, as opposed to the orienter which provides the control mechanism. By combining the measured depth with the attitude of the tool, for a series of points along the wellbore, it is possible to define the path of the wellbore in 3-D space, using techniques such as the Minimum Curvature Method.

The sensor section 30 also contains a gamma ray sensor 44, which measures the natural gamma radiation of the rocks around the wellbore. Each rock formation emits in different ways and the distribution of the different signal levels can be used for depth correlation and to identify that a particular formation has been drilled through. In thin formations it is possible to identify the relative position of the borehole in the strata by adapting the gamma ray sensor so that it is focussed i.e. it responds preferentially to radiation in one direction. By rotating the sensor through 360° the form of the resulting signal distribution shows where the BHA is in relation to top and the bottom of the strata.

The gamma ray sensor is positioned lowest, directly behind the mud motor and the directional sensors are positioned directly above that. This order is chosen so that the directional sensors are spaced away from the magnetic interference of the mud motor. The remaining weight-on-bit, torque-on-bit and pressure/temperature sensors are disposed below the orienter but not so that they interfere with the positioning of the GR and directional sensors.

The motor 32 is housed beneath the sensor section 30. A typical motor is a positive displacement Moineau type with an adjustable bent sub set back typically 36"-48" from the drill bit. The bend ranges from 0-3° typically and the value is chosen based on the desired build rate (deg/100) of the directional borehole. A feature of drilling with a bent sub motor, that is commonly exploited when directionally drilling with jointed pipe, is the fact that both deviated and straight holes can be drilled by varying between rotating and sliding of the motor. In sliding mode the drill bit will build angle in the direction it is pointed. In rotating mode i.e. with the drill string and drill, motor turning, the drill bit will drill effectively straight as the bit proscribes a spiral drilling pattern.

The drill bit 18 is beneath the drill motor section 32, which is included in the bent section 16 of housing. As previously discussed, this allows the drill bit to be oriented to a particular azimuth (i.e. a particular angle when considered from the axis of the upper part of the housing), allowing either curved or straight drill paths to be drilled. The drill bit 18 can be either a tri-cone, PDC or diamond bit. These are chosen based on rock type, motor speed and all have different properties in relation to penetration and steerability.

Having the directional and gamma ray measurements located closely behind the bit, information about the well path created by the drill bit is relayed back with as minimal delay as possible to prevent deviation from the plan. A feature of directional drilling with a bent sub is that it will continuously build a curve in the direction in which the bend is pointed. In practice, however, well paths consist of a combination of straight and curved sections where the straight section is often horizontal.

By keeping all the electronics together in the area below the orienter the number of interconnections is reduced thereby reducing the length of the tool and also simplifying the wiring with benefits in cost and complexity/reliability.

When a command to rotate the orienter is sent, the whole section below the swivel bearing 35 rotates. This includes all the instrumentation, the motor and bent sub and the bit. The coiled tubing does not rotate other than to the extent caused by reactive torque. Rotating the sensors at the same time as rotating the bent sub has advantages:

The directional sensor can be used to feed back the direction in which the bit is rotated (tool face) as the rotation happens. On some existing systems an extra sensor is required to give this information.

By suitably shielding the GR sensor so that it detects natural gamma radiation preferentially in one direction, it is possible to make a 360° scan around the borehole. The resulting measurement pattern can be used for tool location in thin beds such as coal seams.

The ports of any circulating valve are rotated around the borehole which is a feature which can be used to help prevent build up of drill cuttings on the low side of the hole in horizontal and highly deviated well bores.

The invention claimed is:

1. A drilling assembly comprising a bent section terminating in a drill bit, and a top section coupled to the bent section, the top section being suspended upon coiled tubing, the drilling assembly including an orienter means capable of rotating the bent section with respect to the top section, and with a swivel bearing between the bent section and the top section, wherein the orienter means includes an electric motor drive means for rotating the bent section in either direction with respect to the top section and wherein the electric motor drive means is situated between the swivel bearing and the drill bit, the drilling assembly further comprising sensor means for monitoring downhole physical variables and a mud motor, wherein the sensor means is situated between the electric motor drive means and the drill bit, and wherein the mud motor is situated between the sensor means and the drill bit.

2. The drilling assembly according to claim 1 wherein the sensor means includes a directional sensor which monitors the direction in which the bit is rotated.

3. The drilling assembly according to claim 1 wherein the sensor means includes a gamma radiation detector, adapted to respond preferentially to radiation in one direction.

4. The drilling assembly according to claim 1 wherein the bent section includes a circulating valve through which fluid directed at the drill bit can flow.

* * * * *